United States Patent [19]

Stracener

[11] 4,449,024

[45] May 15, 1984

[54] BACKLIGHTED ILLUMINATED KEYBOARD

[75] Inventor: Steve W. Stracener, Evans, Colo.

[73] Assignee: KB Denver, Inc., Frederick, Colo.

[21] Appl. No.: 491,246

[22] Filed: May 3, 1983

[51] Int. Cl.[3] ..... H01H 9/18

[52] U.S. Cl. ..... 200/317; 200/310; 200/314; 362/26; 362/31

[58] Field of Search ..... 200/310, 311, 312, 313, 200/314, 317, 159 B; 362/23, 24, 31, 26; 179/81 C, 90 L

[56] References Cited

U.S. PATENT DOCUMENTS

| | | | |
|---|---|---|---|
| 2,831,282 | 4/1958 | Hardesty | 362/31 |
| 2,839,670 | 6/1958 | Gladstone | 362/31 |
| 3,584,162 | 6/1971 | Krakinowski | 200/159 B |
| 3,590,195 | 6/1971 | Driver | 200/159 B |
| 3,755,661 | 8/1973 | Bouvrande | 200/DIG. 47 |
| 3,811,025 | 5/1974 | Bach | 200/317 |
| 4,124,879 | 11/1978 | Schoemer | 362/26 |
| 4,177,501 | 12/1979 | Karlin | 200/314 |
| 4,197,439 | 4/1980 | Mecklenburg et al. | 200/159 B |
| 4,262,182 | 4/1981 | Basler et al. | 200/159 B |
| 4,320,268 | 3/1982 | Brown | 200/314 |
| 4,343,975 | 8/1982 | Sado | 200/314 |
| 4,349,705 | 9/1982 | Kuhfus | 200/314 |

*Primary Examiner*—John W. Shepperd
*Attorney, Agent, or Firm*—Lloyd L. Zickert

[57] ABSTRACT

A backlighted illuminated keyboard including a printed circuit board on which is mounted in a central location a single lamp easily replaceable from the backside of the board and which extends into a clear plastic light diffuser over which an overlay is disposed and a bezel is provided to define key areas in the translucent overlay such that the single lamp disperses light energy through the diffuser to light up the entire overlay. The single lamp is mounted in a socket formed in the printed circuit board and held in place by a swivel arm which can be swung to one side to allow ease of removal of the lamp.

17 Claims, 6 Drawing Figures

BACKLIGHTED ILLUMINATED KEYBOARD

DESCRIPTION

This invention relates in general to a keyboard assembly, and more particularly to a backlighted illuminated keyboard useful where poor light situations exist, and still more particularly to a backlighted illuminated keyboard that is illuminated by a single lamp which may be easily replaced from the back of the keyboard.

Heretofore, there have been many different types of illuminated keyboards. Several of these keyboards, such as that disclosed in U.S. Pat. No. 4,320,268 and which utilizes an electroluminescent panel, are no longer useful when the light source fails and needs to be replaced. It is not practical to replace an electroluminescent panel in a keyboard assembly, so if it fails and there is a continuing need to provide illumination, the keyboard must be replaced. Other keyboard structures, such as those shown in U.S. Pat. Nos. 4,197,439; 4,343,975 and 4,365,120 are likewise constructed such that once the light source fails, it is not economically practical to repair the keyboard, and if continued illumination is needed, the keyboard must be replaced.

The present invention overcomes the problems heretofore encountered in illuminated keyboards in providing a keyboard assembly that is illuminated with a single miniature lamp that may be easily replaced when it fails. Moreover, such a single lamp is more economical to operate, dissipates low heat to the keyboard, and requires less current to operate where batteries are the source of power. The illuminated keyboard of the present invention also includes tactile feedback in the key areas. More particularly, the keyboard includes a printed circuit board having a plurality of switch sites, a dome at each of the sites coacting therewith to define a switch having tactile feedback, a light diffuser of substantially the same size as the printed circuit board and resting on the printed circuit board. Actuating plungers or pins are guidably received by the diffuser such that the lower end of an actuating pin is in alignment with the center of and in engagement with a dome. The upper ends of the actuating pins protrude above the diffuser and engage the underside of a graphic overlay made of translucent material and having suitable legends or indicia in alignment with each of the actuating pins. The diffuser is of clear plastic and includes a centrally disposed blind hole into which the single illuminating lamp is received for dispersing light through the diffuser. The lamp is mounted in a socket formed in the printed circuit board and held in place by a swivel arm at the backside of the board. Swinging the swivel arm to one side allows removal and replacement of the lamp. The translucent graphic overlay is of substantially the same dimension as the diffuser and the printed circuit board and rests on top of the diffuser such that it engages the upper ends of the actuating pins. A bezel made of light opaque material is disposed over the overlay and defines key depressing areas for the overlay associated with a given switch and its elements. Energization of the lamp thereby disperses light energy through the light diffuser and uniformly over the translucent overlay from the back of the overlay such that the graphics on the overlay can be easily read in poor light conditions.

It is therefore a object of the present invention to provide a new and improved illuminated keyboard that is backlighted and includes tactile feedback in each of the key areas.

A further object of the present invention is to provide a new and improved illuminated keyboard which is illuminated by a single lamp that may be easily removed and replaced from the backside of the printed circuit board.

A still further object of the present invention is in the provision of an illuminated keyboard that is useful for poor light situations and which is illuminated by a single lamp having a low current requirement and low heat dissipation and which contributes to the overall inexpensive construction of the keyboard.

Other objects, features and advantages of the invention will be apparent from the following detailed disclosure, taken in conjunction with the accompanying sheet of drawings, wherein like reference numerals refer to like parts.

Figures 1, 2, 3, 4, 5, 6:
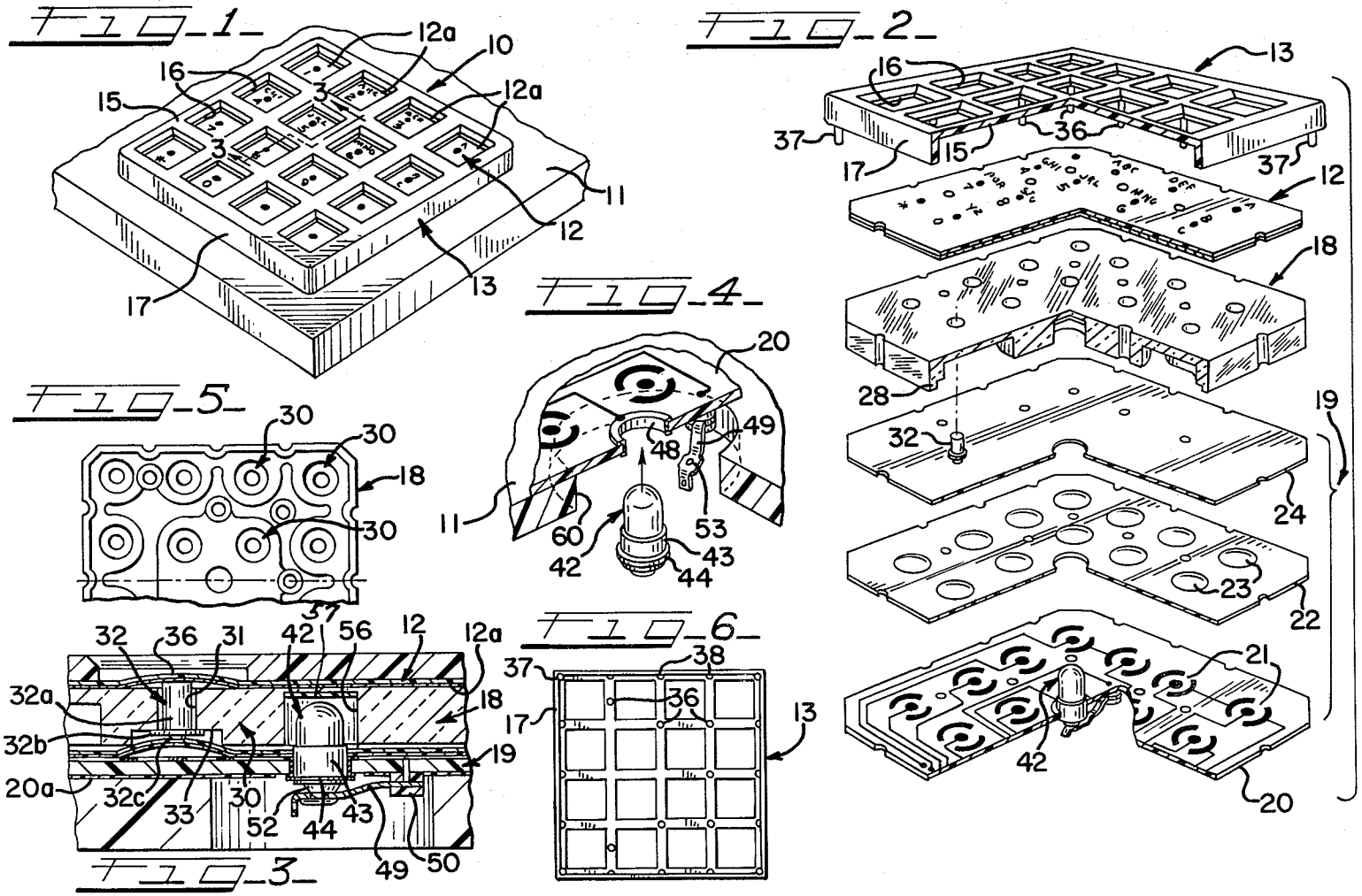
FIG. 1 is a perspective view of the illuminated keyboard of the present invention mounted on a panel.
FIG. 2 is an exploded perspective view of the illuminated keyboard of the invention wherein some of the parts have portions cut away to show underlying parts and for purposes of clarity.
FIG. 3 is a greatly enlarged detailed vertical sectional view taken substantially along line 3—3 of FIG. 1.
FIG. 4 is a greatly enlarged perspective cutaway view of the central portion of the printed circuit board and illustrating the manner in which the single lamp may be easily removed and replaced.
FIG. 5 is a fragmentary bottom plan view of the light diffuser used in the keyboard of the invention.
FIG. 6 is a bottom plan view of the bezel.

Referring now to the drawings, and particularly to FIG. 1, the illuminated keyboard of the present invention is generally designated by the numeral 10 and illustrated as being mounted on a panel 11. Visible in FIG. 1 is the graphic overlay 12 and the bezel 13 which are structured to coact with the overlay to define a plurality of key areas 12*a*. Each key area includes a distinctive legend or legends and are backlighted to make them readable in a poor light situation for use by the operator. As will become more apparent hereafter, depressing of any key area would cause actuation of the switch for that particular key area. The key areas 12*a* are defined by the top panel 15 of the bezel 13 which includes a plurality of symmetrically arranged openings or windows 16 square in form and allowing access to the graphic overlay. The shape of the openings may be circular or otherwise formed if so desired. The periphery of the bezel includes a downwardly extending skirt or vertical wall 17 within which all of the other elements of the keyboard are received, as will be hereafter discussed.

While the keyboard illustrated shows sixteen different key areas, it can be appreciated that any number may be provided depending upon the needs of the particular installation, and the keyboard shape may be other than as illustrated.

In addition to the graphic overlay 12 and the bezel 13, the keyboard assembly also includes a light diffuser 18 below the overlay and a printed circuit board subassembly 19. The subassembly 19 is shown in exploded form in FIG. 2 and includes the printed circuit board 20 having a plurality of symmetrically arranged switch sites 21 thereon, a transparent dome seal or retainer 22, the underside of which has an adhesive surface and has disposed thereon a plurality of domes 23, and an opaque RIF/EMI shield 24. The underside of the shield is also adhesive coated to adhesively join with the upper side of the dome retainer sheet 22. Similarly, the dome retainer sheet 22 adhesively engages the top side of the printed circuit board 20, and the assembled relation of these elements is illustrated in FIG. 3. A dust cover 20*a* in the form of a suitable adhesive coated sheet is applied to the bottom of the printed circuit board 20.

The combined elements designated in general by the numeral 19 may also be defined as a switch assembly for the keyboard in that the switch sites of the printed circuit board coact with the domes mounted thereon to define switches which when subjected to a depressing force causes closing of the switch for a depressed dome and upon being released causes opening of the switch. The domes provide a tactile feedback which can be sensed by the person depressing and releasing a dome in a manner more fully described in U.S. Pat. No. 3,967,084. Actuation of a dome to close a switch is preferably accomplished by applying a force to the center of the dome, as will be more clearly described hereafter.

The outer peripheral dimension of the switch assembly 19 is about the same size as that of the light diffuser plate 18 and abuts against the diffuser plate when in assembled relation therewith and particularly against the outer lip or skirt 28 which allows the domes to be received within the skirt, as seen particularly in FIG. 3.

The light diffuser plate 18 is made of a clear plastic material of any suitable type such as a polycarbonate to enhance the diffusion of light energy across the keyboard. Like the switch assembly 19, the light diffuser plate also is rectangular or square in form although it may take any desired form depending upon the design of the keyboard.

As seen in both FIGS. 2 and 5, the plate may be made by a suitable molding operation and includes a plurality of dome actuating pin or plunger guide sections 30, each having a pin guide bore 31 for guidably receiving dome actuating pins or plungers 32. Each pin includes a main barrel shaped body portion 32*a*, an annular flange 32*b* at its bottom end, and a diametrically reduced dome engaging projection 32*c* below the flange. A pin is centrally aligned with each dome in a manner shown in FIG. 3 whereupon depression of the pin causes like depression of the dome and closing of the switch thereof. The flange 32*b* is diametrically sized larger than the pin guiding bore 31 to define a stop and prevent upward movement of the pin beyond the guide section. Thus, depressing of the pin moves the flange downwardly and away from the bottom surface of the guide section and release thereof allows the pin flange to return to a home position abutting the guide section. To further facilitate the proper fitting of a pin relative to the guide section, a recess 33 is provided at the lower end of the guide section. Moreover, when the pin is in home position, the upper end of the pin extends above the upper surface of the light diffuser plate, as particularly shown in FIG. 3.

Disposed on the upper side of the light diffuser plate is the graphic overlay 12 which is formed from a suitable flexible plastic material. Moreover, the peripheral dimensions of the overlay are substantially equal to both the light diffuser plate 18 and the switch assembly 19. The overlay is provided with a plurality of areas in which indicia is imprinted thereon and then each area of the overlay is embossed as at 36 which is as seen in FIG. 3, in alignment with the upper end of a dome actuating plunger or pin. A depressing force on the overlay at a key area causes movement of the overlay, the pin in alignment with that key area and the dome in alignment with the pin to close the switch thereof. In order to contrast the light opaque indicia which may be applied with a dark color, the overlay is white and translucent to allow light to pass through and highlight the indicia. Preferably, a white translucent coating 12*a* is provided on the underside of the overlay.

The bezel 13 is of a light opaque plastic material and serves not only to maintain the overlay, diffuser plate and switch assembly together in assembled relation but also to divide the overlay into key areas, as indicated at 12*a* in FIG. 1. The bezel includes a lattice type upper panel with the openings or windows 16 arranged to coact with the indicia on the overlay such that the indicia are exposed through the openings and allows pressure to be applied to the key areas through the openings in order to actuate a switch. The downwardly extending skirt 17 of the bezel forms an outer wall within which the overlay, diffuser plate and switch assembly are received, as can be appreciated in FIGS. 2 and 6. The bezel includes a plurality of downwardly extending guide or aligning pins 36 which assist in guidably receiving the overlay, diffuser plate and switch assembly, all of which have guide holes formed therein. When the overlay, diffuser plate and switch assembly are properly assembled within the bezel 13, the tip ends of the guide pins 36 may be deformed over the backside of the switch assembly to lock these elements together.

The bezel is also provided with corner panel mounting pins 37 to facilitate mounting of the keyboard on a panel, such as panel 11 shown in FIG. 1. To further provide proper alignment between the overlay, diffuser plate and switch assembly, a plurality of aligning ridges 38 are formed on the interior surface of the skirt or wall 17 and for mating with notches formed in the peripheral surfaces of the overlay, diffuser plate and switch assembly. The aligning ridges 38 are seen in the bottom plan view of the bezel in FIG. 6, while the aligning notches of the other elements are seen particularly in FIG. 2.

A single light source is provided for illuminating the keyboard. This light source is in the form of a miniature incandescent lamp 42 which is centrally mounted in the keyboard for providing light energy that is substantially uniformly dispersed throughout the keyboard for backlighting the overlay 12. A single lamp is less expensive and more reliable and has a low current requirement. Likewise, it has a low heat dissipation for enhancing the overall life of the keybaord. It may also be of a standard off-the-shelf type as it is replaceable. For example, it may be what is known as a T-1 sub-midget flange base lamp. The lamp includes a base 43 having a circumferential flange 44.

The lamp is mounted in a socket 48 formed on the printed circuit board 20 and centrally of the board. The socket is in the general form of a soldered-through hole or provided with an electrically conductive sleeve which defines one of the electrical contacts for the lamp. As seen particularly in FIGS. 3 and 4, the lamp is inserted into the socket from the back of the printed circuit board until the flange 44 bottoms on the socket 48. A swingable contact arm 49 pivotally mounted to a post 50 on the board is swung over beneath the lamp to resiliently engage the other electrical contact 52 of the lamp. The arm is provided with an aperture 53 which mates with the tip end of the contact 52 and effects a spring biased detenting action therewith in order to maintain the arm in contact relation with the lamp. Thus, electrical power may be applied to the socket and the arm in order to apply voltage to the lamp and energize it.

In order to accommodate the lamp, it will be appreciated that holes likewise will be formed in the dome seal 22 and the shield 24. Also, a blind hole 56 is formed in the bottom of the light diffuser plate 18 into which the lamp extends. At the base of the hole a black plug 57 prevents light energy from being dispersed upwardly and therefore assists in causing the light energy to laterally diffuse through the diffuser plate.

As seen particularly in FIG. 4, the manner in which the lamp may be removed is illustrated where the swingable metal arm 49 is swung to one side of the lamp in order to allow the lamp to be removed from the socket 48. A new lamp may be easily mounted by inserting it into the socket and swinging the swivel arm over the end of the lamp into snap-fit relation therewith. The panel 11 is also illustrated in FIG. 4 as having an access hole 60 for facilitating removal and replacement of the lamp.

It can therefore readily be appreciated that the illuminated backlighted keyboard of the present invention is unique, inexpensive to make and to maintain, and provides illumination in the graphic overlay to facilitate reading the indicia on the overlay in poor light situations.

It will be understood that modifications and variations may be effected without departing from the scope of the novel concepts of the present invention, but it is understood that this application is to be limited only by the scope of the appended claims.

The invention is hereby claimed as follows:

1. An illuminated keyboard comprising, a switch assembly having a printed circuit board with a plurality of switch sites and a dome coacting with each said site to define a switch, a light diffuser above said switch assembly, a plurality of dome actuating pins guidably received in said diffuser, one each aligned with a dome and one end of which engages a dome, a translucent graphic overlay above said diffuser engaging the other ends of said pins, an opaque bezel over said overlay defining a plurality of key areas for said overlay, one each aligned with an actuating pin, whereby pressure in a key area causes depression of a pin and actuation of the dome in alignment therewith to close the switch including said dome, a single light source for lighting the entire overlay, and means removably and centrally mounting said light source on said printed circuit board such that it extends into said diffuser for transmitting light energy therethrough to light the key areas of the entire overlay.

2. An illuminated keyboard as defined in claim 1, wherein said light source is in the form of a lamp having a flange base, and said mounting means therefor includes a socket in said printed circuit board and a swivel arm mounted on the underside of said board and movable over the base end of said lamp to selectively lock it to said board and to electrically connect it to said board.

3. An illuminated keyboard as defined in claim 2, wherein the lamp is replaceable from the bottom of said board by swinging the swivel arm to one side of the base end of the lamp.

4. An illuminated keyboard as defined in claim 3, wherein said socket and said arm are electrically connected to a source of electrical energy for energizing said lamp.

5. An illuminated keyboard as defined in claim 4, wherein said bezel is of light opaque material.

6. An illuminated keyboard as defined in claim 5, wherein said diffuser includes a blind hole for receiving said lamp fitted with means to cause lateral dispersion of the illuminating energy of said lamp.

7. An illuminated keyboard as defined in claim 1, wherein the underside of said overlay includes a white translucent coating to enhance the dispersion of light energy over its entire area.

8. An illuminated keyboard as defined in claim 1, wherein said overlay may be easily changed to suit particular switching needs.

9. An illuminated keyboard as defined in claim 1, wherein each actuating pin moves along an axis perpendicular to each said dome.

10. An illuminated keyboard as defined in claim 1, wherein said diffuser is of clear plastic material.

11. An illuminated keyboard as defined in claim 1, wherein said bezel includes guide means for aligning the overlay, diffuser and switch assembly are aligned with each other by said guide means.

12. An illuminated keyboard as defined in claim 11, wherein the overlay, diffuser and switch assembly are of the same size such that the peripheral edges align with each other.

13. An illuminated keyboard as defined in claim 12, wherein aligning notches are provided in the peripheral edges of said overlay, diffuser and switch assembly to coact with said guide means of said bezel.

14. An illuminated keyboard as defined in claim 13, wherein said bezel guide means includes guide pins coacting with holes in said overlay, diffuser and switch assembly, and bar members coacting with said aligning notches.

15. An illuminated keyboard comprising, a switch assembly including a printed circuit board having a plurality of switch sites, and a dome mounted on said board at each switch site and coacting therewith to define a switch which provides tactile feedback on actuation and when depressed closes and when released opens, a light diffuser plate above and against said switch assembly, said plate being capable of diffusing light energy supplied centrally thereof, a plurality of dome actuating plungers guidably received by said light diffuser plate, one each aligned with a dome and when depressed causes depression of the dome to close the switch thereof, a translucent graphic overlay above said diffuser plate having indicia thereon in a plurality of areas, the depression of an area of which is in alignment with a dome actuating plunger causes depression of that plunger to close a switch, an opaque bezel for receiving said switch assembly, light diffuser plate and overlay in alignment with each other and having window means for defining key areas on said overlay corresponding with dome actuating plungers and switches, and means for illuminating said overlay from the backside to facilitate reading the indicia on the overlay in poor light situations, said illuminating means including a lamp centrally mounted on said printed circuit board and extending into an aperture of the light diffuser plate, and means mounting said lamp such that it can be removed and replaced from the back of the board.

16. An illuminated keyboard as defined in claim 15, wherein said lamp mounting means includes a socket in said printed circuit board and an arm swingably mounted on said board and movable over the base end of said lamp to retain the lamp in said socket.

17. An illuminated keyboard as defined in claim 16, wherein said socket and said arm are connected to a source of voltage.

* * * * *